US006293441B1

(12) United States Patent
Tasaki et al.

(10) Patent No.: US 6,293,441 B1
(45) Date of Patent: Sep. 25, 2001

(54) TRIGGER TYPE LIQUID SPRAY CONTAINER FOR OPERATION IN BOTH UPRIGHT AND INVERTED POSITIONS

(75) Inventors: Takaharu Tasaki; Haruo Tsuchida; Hiroyuki Nakamura, all of Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/530,543

(22) PCT Filed: Sep. 10, 1999

(86) PCT No.: PCT/JP99/04930

§ 371 Date: May 8, 2000

§ 102(e) Date: May 8, 2000

(87) PCT Pub. No.: WO00/15349

PCT Pub. Date: Mar. 23, 2000

(30) Foreign Application Priority Data

Sep. 11, 1998 (JP) ..... 10-276557
Sep. 24, 1998 (JP) ..... 10-288822

(51) Int. Cl.[7] ..... B67D 5/40
(52) U.S. Cl. ..... 222/376
(58) Field of Search ..... 222/321.4, 402.19, 222/376, 383.1

(56) References Cited

U.S. PATENT DOCUMENTS 5,341,967 * 8/1994 Silvenis ..... 222/376
5,462,209 * 10/1995 Foster et al. ..... 222/376
5,467,901 * 11/1995 Foster et al. ..... 222/376
5,540,360 * 7/1996 Foster et al. ..... 222/376

FOREIGN PATENT DOCUMENTS

A-1-69658 5/1989 (JP) .
A-6-18930 5/1994 (JP) .
A-9-75800 3/1997 (JP) .
A-9-164350 6/1997 (JP) .

* cited by examiner

*Primary Examiner*—Kevin Shaver
*Assistant Examiner*—Stephanie L. Willatt
(74) *Attorney, Agent, or Firm*—Oliff & Berridge PLC

(57) ABSTRACT

The present invention proposes a trigger-type liquid discharge container which can be used in an inverted posture and in a horizontal posture having its ejection pipe directed downward. Said container is constructed, by fitting the upper portion of a liquid suction tube 121, in which a valved tube 141 and a suction pipe setting tube 151 are fitted, in a base tubular portion 103;

by providing communication between a suction pipe 156 depending from a second longitudinal tube 154 and a main tube 106 through both a first longitudinal tube 144 and the second longitudinal tube 154, which respectively extend through first and second transverse walls 142 and 152 of the valved tube and the suction pipe setting tube;

by forming a liquid suction port 127 for the inverted posture in the front portion of the upper end of the liquid suction pipe portion, as depending downward from the lower end of the base tubular portion 103;

by providing an air suction preventing valve 162 in the front portion of the first transverse wall 142 under said suction port, and by forming an opening 148 in the longitudinal tube portion between the first and second transverse walls 142 and 152.

8 Claims, 9 Drawing Sheets

TRIGGER TYPE LIQUID SPRAY CONTAINER FOR OPERATION IN BOTH UPRIGHT AND INVERTED POSITIONS

BACKGROUND OF THE INVENTION

1. Field of the Invention

The present invention relates to a trigger-type liquid discharge container usable in both ordinary and inverted postures.

2. Description of Related Art

As disclosed in Japanese Utility Model Laid-Open No. 1-69658, for example, there is known a trigger-type liquid discharge container comprising a container body with a neck portion, a discharge body, and a mounting tube, said discharge body including:

a first main member having a suction tube raised from an inside of a rear portion of a base tube;

and a second main member having an outer tube fitted on an outer face of said suction tube, a cylinder protruding forward from a lower portion of the outer tube, an ejection pipe protruding forward from an upper end portion of the outer tube, each said cylinder and ejection pipe communicating with the suction tube respectively, an outwardly flanged wall which is formed on the lower portion of said outer tube and has a rear bottom wall portion of said cylinder as a common wall, a cover tube depending from an outer circumference of the outwardly flanged wall and being fitted on an upper outside of said base tube.

Said base tube has at its intermediate portion an outward flange, and said mounting tube is depending turnably from an inward flange, which is formed on an upper end of the mounting tube and resting on a rim of the outward flange at its upper face, and said fitting tube being fastened on an upper face of the neck portion of the container body. In this liquid discharge container, a trigger is hinged to depend from the front portion of the ejection tube, and a plunger, as fitted in said cylinder while being biased forward, is jointed at its front end to the rear face of the upper portion of said trigger, so that the liquid in the container body can be sucked into the cylinder through the suction valve by the sliding motions of the plunger caused by the triggering actions and so that the liquid in said cylinder can be discharged through the discharge valve from a nozzle fitted in the front end of the ejection pipe.

In the liquid discharge container described above, on the other hand, a three-way branch pipe member having a ball valve is fitted at its main tube in the lower portion of aforementioned suction tube, and a suction pipe depends into the bottom portion of the container body through the first branch tube branched downward from the lower end of said main tube whereas the second branch tube is raised upward from the lower end of the main tube, so that the liquid in the container body may be sucked through the first branch tube and the main tube, when the container is in the ordinary posture, and through the second branch tube and the main tube, when in the inverted posture, into the cylinder.

SUMMARY OF THE INVENTION

In the aforementioned liquid discharge container, by fitting the upper end portion of the main tube into the lower portion of the suction tube of the first main member, the three-way branch tube member having the ball valve is made to depend into the container body, and the suction pipe is made to depend from the first branch tube branched downward from the lower end of the main tube. However, the above mentioned three-way branch tube member raises an obstruction for its handling, when the discharge body is to be removed from the container body and mounted on the same at the time of supplying the container body with the liquid, On the other hand, the three-way branch tube member and the first main member of the discharger are jointed merely by fitting the main tube of the three-way branch tube member into the suction tube of said first main member. If the suction pipe and the three-way branch tube member touch the neck portion of the container body when they are to be inserted into the container body for the aforementioned liquid supply, for example, a force is established to push the three-way branch tube member sideway with respect to the discharge container and is concentrated at the upper end of the main tube portion depending from the lower end of the suction tube, so that those portions are liable to be damaged.

The present invention eliminates the above-specified defects and simplifies the structure for sucking the liquid when the container body is inverted.

In order to solve the aforementioned problems, the present invention proposes the following technical means.

According to first means, in a trigger-type liquid discharge container usable in both ordinary and inverted postures, comprising a container body with a neck portion, a discharge body 1, and a mounting tube 21, said discharge body including:

a first main member 2 having a suction tube 4 raised from an inside of a rear portion of a base tube 3;

and a second main member 11 having an outer tube 12 fitted on an outer face of said suction tube, a cylinder 13 protruding forward from a lower portion of the outer tube 12, an ejection pipe 14 protruding forward from an upper end portion of the outer tube 12, each said cylinder and ejection pipe communicating with the suction tube respectively, an outwardly flanged wall 15 which is formed on the lower portion of said outer tube and has a rear bottom wall portion of said cylinder as a common wall, a cover tube 16 depending from an outer circumference of the outwardly flanged wall 15 and being fitted on an upper outside of said base tube 3;

said base tube 3 having an intermediate portion on which an outward flange 3*a* is provided;

said mounting tube 21 depending turnably from an inward flange 22, which is formed on an upper end of the mounting tube 21 and resting on a rim of the outward flange 3*a*, and said mounting tube being fastened on an upper face of the neck portion of the container body; characterized:

in that said first main member 2 is further defined by that said base tube 3 has an open top, and a partition 31 is transversely provided in the intermediate portion of the base tube 3, and said suction tube 4 extends upwardly from a rear part of said partition 31, while a lower part of said suction tube 4 penetrating downwardly therethrough;

in that said discharge container also comprises a suction pipe setting tube 41 having a bottom plate 42, and a first circumferential wall 43 which extends upwardly from an outer circumference of the bottom plate 42 and has a upper wall portion fitted watertightly into a lower portion of the said base tube 3, and a suction pipe 7 which depends downward from a rear portion of said bottom plate 42 while the suction pipe is opened to an upper face of said bottom plate;

in that said discharge container further comprises a valved member 51 having a top plate 53, a second circumferential wall 54 which depends from an outer circumference of the top plate 53 and is fitted in a lower portion of said first circumferential wall 43, and a joint tube 52 which extends upwardly from a rear portion of the top plate 53 and penetrates downwardly therethrough, while an upper portion of said joint tube 52 being fitted into the lower part of the suction tube 4, while the joint tube is communicating with the suction pipe 7, said top plate having a front portion which is formed into a valve seat 55 tapering to have a small diameter lower end portion, in which a valve hole 56 is provided, while a ball valve 57 being placed on the tapered valve seat, and the joint tube 52 having below the top plate 53 an opening 58 communicating with the valve hole 56;

in that a valve chamber 32 having a lower face opened is extending downward from a front portion of the partition 31 of the first main member to an area above the ball valve 57, while a liquid inlet port 45 for the inverted posture is opened at an upper front portion of the first circumferential wall 43, and a liquid inlet passage 34 for the inverted posture is formed for communicating the valve chamber and the liquid inlet port, and a front wall face in the valve chamber is formed into a slope 33 having a lower end from which the slope is inclined towards an upper back direction, while the lower end of said slope being close to an upper front face of the ball valve 57.

A second means includes all features of the first means and is also characterized in that: a first small hole 17 is formed in a front portion of the outwardly flanged wall 15 of the second main member 11, a second small hole 35 is formed in either of a right or left side portion of the partition 31 of the first main member circumferentially apart from the liquid inlet port 45 for the inverted posture, and a longitudinal channel 46 is formed in either the inside of the base tube 3 or an outer face of the first circumferential wall 43 below the second small hole, so that an ambient air supply passage for supplying the ambient air into the container body is formed of said first small hole 17, a space in a portion of the base tube 3 above the partition, said second small hole 35, and said longitudinal channel 46.

According to third means, in a trigger-type liquid discharge container usable in both ordinary and inverted postures, comprising a container body with a neck portion, a mounting tube fitted on the neck portion, a base tubular portion including a top wall and having a smaller external diameter than that of the mounting tube, said base tubular portion erecting from an inside of an upper part of the mounting tube, a main tube erecting from and penetrating through the top wall of the base tubular portion, a cylinder protruding forward from a front face of the main tube, an ejection pipe protruding forward from a top end of the main tube, a trigger which is hinged to and depending from a front portion of the ejection pipe, a plunger which is fitted in the cylinder and has an front portion engaged with an upper rear portion of the trigger, characterized:

in that the discharge container further includes a liquid suction tube 121 for the inverted posture having an upper portion which is fitted into said base tubular portion 103 while leaving a space in an upper portion of said base tubular portion, a valved tube 141 which is fitted in an intermediate portion of said liquid suction tube 121, and a suction pipe setting tube 151 which is fitted in a lower inner surface of said liquid suction tube 121;

in that said liquid suction tube 121 includes a depending tube 123, depending from a top plate 122 which shuts off an upper surface of the liquid suction tube, while said valved tube 141 has a first transverse wall 142 through which a first longitudinal tube 144 is penetrating, and said suction pipe setting tube 151 has a second transverse wall 152 through which a second longitudinal tube 154 is penetrating, and that a liquid suction passage for the ordinary posture is provided by fitting a lower end portion of said main tube 106 water-tightly in the depending tube 123, and by communicating the main tube 106 and a suction pipe 156 depending from the second longitudinal tube 154 through the first and second longitudinal tubes 144 and 154;

in that the liquid suction tube 121 for the inverted posture has a tubular part which depends below a lower end of said base tubular portion 103, and has at a front upper end of said tubular part a liquid suction port 127 for the inverted posture, while the first transverse wall 142 of the valved tube 141 has a front portion which is formed into a tapered valve seat 145 in a vicinity of a lower edge of said liquid suction port 127, said tapered valve seat 145 having a small diameter lower portion and receiving a ball valve 161 thereon to form an air suction preventing valve 162 for the ordinary posture, while a valve chamber 131 is formed around an upper side of said ball valve 161, a front face of said valve chamber being formed into a slope 128 which is inclined to an upper rear direction so as to keep a lower end of the slop 128 close to a front upper part of the ball valve 161, and;

in that an opening 148 is formed in a front portion of the first or second longitudinal tube between the first transverse wall 142 of the valved tube and the second transverse wall 152 of the suction pipe setting tube, to provide a communication between a valve hole 146 at a lower end of said valve seat and the liquid suction passage.

According to fourth means, in a trigger-type liquid discharge container usable in both ordinary and inverted postures, comprising a container body with a neck portion, a mounting tube fitted on the neck portion, a base tubular portion including a top wall and having a smaller external diameter than that of the mounting tube, said base tubular portion erecting from an inside of an upper part of the mounting tube, a main tube erecting from and penetrating through the top wall of the base tubular portion, a cylinder protruding forward from a front face of the main tube, an ejection pipe protruding forward from a top end of the main tube, a trigger which is hinged to and depending from a front part of the ejection pipe, a plunger which is fitted in the cylinder and has a front portion engaged with an upper rear portion of the trigger, characterized:

in that the discharge container further includes a liquid suction tube 121 for the inverted posture having an upper portion which is fitted into said base tubular portion 103 while leaving a space in an upper portion of said base tubular portion, a valved tube 141 which is fitted in an intermediate portion of said liquid suction tube 121, and a suction pipe setting tube 151 which is fitted in a lower inner surface of said liquid suction tube 121;

in that said liquid suction tube 121, having an upper surface being shut off by a top plate 122, includes a rising tube 125*a* penetrating through a rear portion of the top plate 122 and having an upper portion which is fitted water-tightly into a lower portion of the main tube 106, while said valved tube 141 has a first transverse wall 142 having a rear portion provided with an aperture from which circumference a first longitudinal tube 144 is standing, an upper part of said first longitudinal tube being fitted on a lower outer face of said rising tube 125*a*, and said suction pipe setting tube 151 has a second transverse wall 152 having a rear portion through which a second longitudinal tube 154 is penetrating, and that a liquid suction passage for the ordinary posture is provided by communicating the main tube 106 and a suction pipe 156 depending from the second longitudinal tube 154 through the first and second longitudinal tubes 144 and 154 and the rising tube 125*a;* in that the liquid suction tube 121 for the inverted posture has a tubular part which depends below a lower end of said base tubular portion 103, and has at a front upper end of said tubular part a liquid suction port 127 for the inverted posture, while the first transverse wall 142 of the valved tube 141 has a front portion which is formed into a tapered valve seat 145 in a vicinity of a lower edge of said liquid suction port 127, said tapered valve seat 145 having a small diameter lower portion and receiving a ball valve 161 thereon to form an air suction preventing valve 162 for the ordinary posture, while a valve chamber 131 is formed around an upper side of said ball valve 161, a front face of said valve chamber being formed into a slope 128 which is inclined to an upper rear direction so as to keep a lower end of the slop 128 close to a front upper part of the ball valve 161, and a longitudinal ridge 149 sloped to an upper rear direction is formed from an inside of a rear portion of the valve seat 145 to a lower front face of the first longitudinal tube 144;

in that an opening 148 is formed in a front portion of the first or second longitudinal tube between the first transverse wall 142 of the valved tube and the second transverse wall 152 of the suction pipe setting tube, to provide a communication between a valve hole 146 at a lower end of said valve seat and the liquid suction passage.

A fifth means includes all features of the third or fourth means and is also characterized in that a first hole 116*a* is formed in a front portion of the top wall 105 of the base tubular portion as an exit hole of an ambient air supply passage 116 communicating with an inside of the cylinder, and a portion of the top wall of the base tubular portion under said first hole is raised to form a short tube 126 having a closed upper face;

in that the discharge container further comprises a valve member 175 having a tubular member 172 with an upper end face from which a plurality of elastic helical members 173 are raised equidistantly, while a valve plate 174 being provided at upper ends of the plurality of elastic helical members, so that a lower face of the first hole is shut by fitting said tubular member on an outer face of the short tube 126 and by forcing the valve plate 174 to contact with the first hole;

in that the discharge container also comprises a channel 132 for communicating a space in the upper portion of the base tubular portion and an inside of the container body, said channel is longitudinally formed, spaced circumferentially from said liquid suction port for the inverted posture, either in an upper outer face of the liquid suction tube 121 for the inverted posture or in an inner face of the base tubular portion 103 as opposed to the upper outer face of the liquid suction tube.

A six means includes all features of the first, second, third, fourth, or fifth means and is also characterized in that the liquid inlet port 45 for the inverted posture or the liquid suction port 127 for the inverted posture is positioned in the neck portion of the container body above a lower end of the mounting tube 21 or 102.

A seventh means includes all features of the first, second, third, fourth, fifth or six means and is also characterized in that said container body has a trunk portion, a lower part of which is largely bulged forward at its lower part with respect to a center axis of the truck portion, whereas the suction pipe 7 or 156 is bent towards a lower front direction to bring a lower end of the suction pipe close to a front end of a bottom wall of the container body.

An eighth means includes all features of the first, second, third, fourth, fifth, six, or seventh means means and is also characterized in that the suction pipe, depending from the discharge body usable in both the ordinary and inverted postures, has a substituting ambient air suction port 202 which is formed in a lower portion of the suction pipe in a vicinity of a lower end opening 201 of said suction pipe.

DETAILED DESCRIPTION OF THE INVENTION

Figure 1:
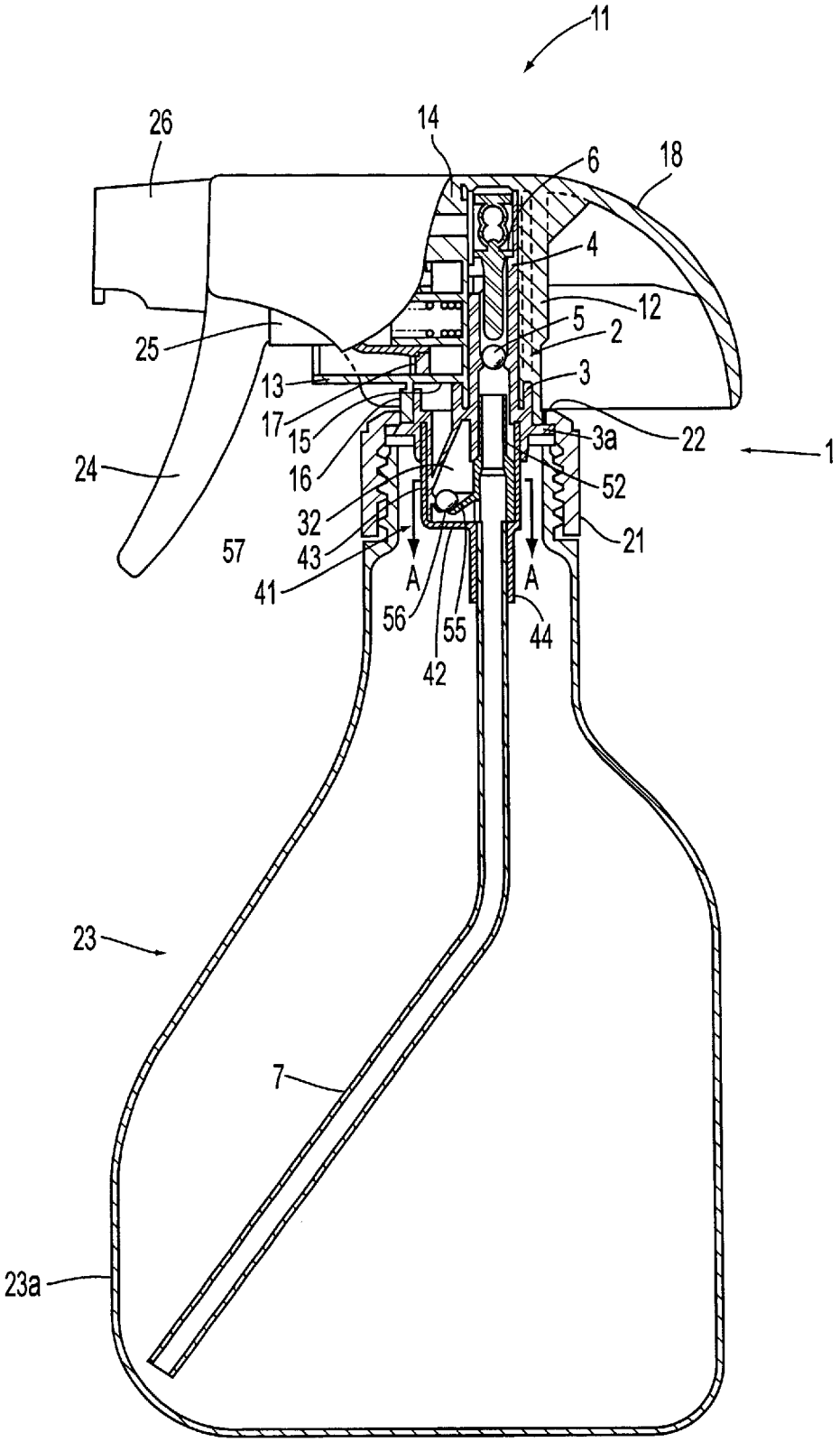
FIG. 1 is a longitudinal section of a liquid discharge container according to the invention.

Here will be described a first embodiment, as shown in FIGS. 1 to 5. First of all, the portions known in the prior art will be described. A discharge body 1 (or a discharger) is constructed of a first main member 2 and a second main member 11.

The first main member 2 is constructed by raising a suction tube 4 from the rear portion of a base tube 3 and is provided with a suction valve 5 in the lower portion of the suction tube and a discharge valve 6 in the upper portion of the suction tube. The base tube 3 is provided with an outward flange 3*a* at its intermediate portion.

The second main member 11 has an outer tube 12 which is fitted on the outer face of the suction tube 4, a cylinder 13 which is protruding forward from the lower portion of the outer tube 12, and an ejection pipe 14 which is protruding forward from the upper end of the upper end of the outer tube 12. These cylinder 13 and ejection tube are communicating with the suction pipe individually. An outwardly flanged wall 15 is formed on on the lower portion of the outer tube 12 by using the rear portion of the bottom wall of the cylinder as a common wall, i.e. a wall which is held in common. A cover tube 16 is depending from the outer circumference of the outwardly flanged wall, and fitted on the outer face of the upper portion of the base tube 3. In the front portion of the outwardly flanged wall surrounded by the cover tube, there is formed a first small hole 17 for forming an ambient air supply passage. The second main member 11 is covered at its outer face with a cover 18.

A mounting tube 21 is depending turnably from the lower portion of the discharge body 1 thus constructed. The mounting tube has an inward flange 22 formed on the upper end thereof for resting on the upper face of a rim of the outward flange 3*a*, such that the mounting tube 21 is removably fastened on the neck portion of a container body 23.

Here, a trigger 24 is hinged to and depending from the front portion of the ejection pipe 14 of the discharge body. The upper rear portion of the trigger is engaged with the front end portion of a plunger 25 which is fitted in the cylinder 13. By swaying the trigger, the plunger 25 is moved back and forth so that the liquid is discharged by the pressure, as generated in the cylinder by the backward movement of the plunger, through the discharge valve 6 from the nozzle hole of a nozzle tube 26 fitted in the front end of the ejection pipe, and so that the liquid in the container body is sucked up by the vacuum caused in the cylinder by the forward movement of the plunger, through the suction valve 5 and a suction pipe 7 depending from the suction tube 4.

The aforementioned first small hole 17 is formed such that it is shut by the outer circumference of the rear end portion of the plunger 25 when this plunger 25 is biased forward to its front limit, and such that the ambient air supply passage having the first small hole 17 as its upper end opening is opened only when the trigger is squeezed against the biasing force to move the plunger backward.

In the present invention, the base tube 3 of the first main member 2 is formed by opening its upper face, by providing a partition 31 transversely in the inner face of its intermediate portion, and by raising the suction tube 4 from the rear portion of the partition while the lower tubular portion of the suction tube is penetrating through the rear portion of the partition. A valve chamber 32 with an open lower surface is depending from the front portion of that partition, on the other hand, such that it is positioned over a later-described ball valve. The rear wall of the valve chamber 32 may be formed of the front wall at the suction tube 4 under the partition, as shown. The front wall of the valve chamber 32 is formed into a slope 33 extending towards an upper rear direction from the lower end of the slope.

Into the lower portion of the aforementioned base tube 3, there depends a suction pipe setting tube 41 which fits liquid-tight the upper portion of a first circumferential wall 43 which is raised from the outer circumference of a bottom plate 42. In that suction pipe setting tube, the bottom plate 42 is opened at its rear portion, and a tubular portion 44 fitting the suction pipe 7 depends from the circumferential edge of the opening. In the upper portion of the front portion of the first circumferential wall 43, on the other hand, there is formed a liquid inlet port 45 for the inverted posture.

A valved member or a valve carrying member 51 is fitted into the lower portion of the first circumferential wall 43 and has a joint tube 52, the upper part of which is fitted into the lower portion of the suction tube 4. The valved member 51 has a top plate 53 from the outer circumference of which a second circumferential wall 54 is depending. The joint tube 52 is extending upwardly from the rear portion of the top plate 53, while the lower tubular portion of the joint tube is penetrating therethrough. The lower rear portion of the joint tube 52 and the rear portion of the second circumferential wall 54 are formed into a common wall, which the joint tube and the second circumferential wall hold in common. The second circumferential wall 54 is water-tight fitted in the lower portion of the first circumferential wall 43. On the other hand, the front portion of the top plate 53 is recessed to form a lower, tapered valve seat 55 of a small diameter, the lower end of which is opened to form a valve hole 56. A ball valve 57 is placed on the valve seat. Moreover, a clearance is formed between the lower face of the valve member and the bottom plate 42 of the suction pipe setting tube 41, while an opening 58 for providing communication between that clearance and the inside of the lower portion of the joint tube 52 is formed in the lower portion of the joint tube under the top plate 53. A liquid-tight communication is provided between the lower end of the joint tube 52 and the suction pipe 7.

Figure 2:
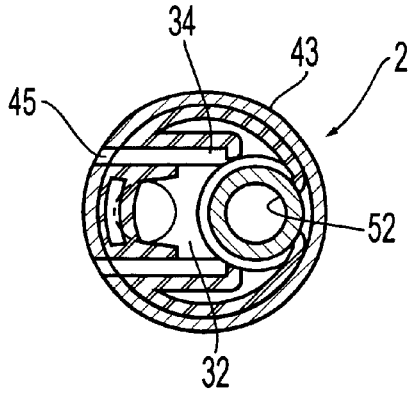
FIG. 2 is an enlarged transverse section taken in the direction of line A—A of FIG. 1.

The lower end of the slope 33 of the aforementioned valve chamber 32 is disposed so close to the front face of the upper portion of the aforementioned ball valve 57 that this ball valve 57 rides to stop on the lower end portion of the slope 33 and slightly leaves the valve seat 55 when the container body 23 is turned to a generally horizontal position to direct the ejection pipe 14 downward. When the container body is inverted, moreover, the ball valve 57 moves along the slope 33 upwardly of the valve chamber (i.e., downwardly of the same in the inverted posture) and stops. Here, there is formed in the valve chamber 32 a liquid inlet passage 34 for the inverted posture, as shown in FIG. 2, to provide communication between the liquid inlet port 45 for the inverted posture and the inside of the valve chamber 32.

Figure 3:
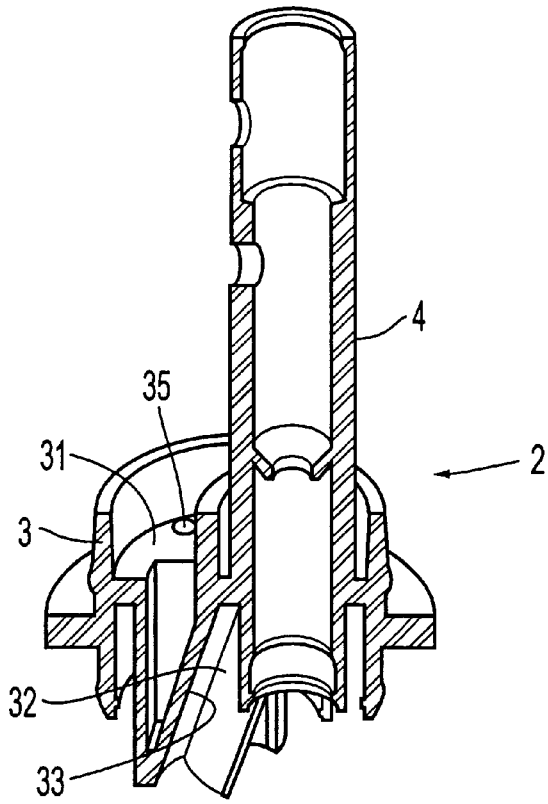
FIG. 3 is an enlarged perspective view showing a main member of the discharge container of FIG. 1 and taken in a longitudinal section.
Figure 4:
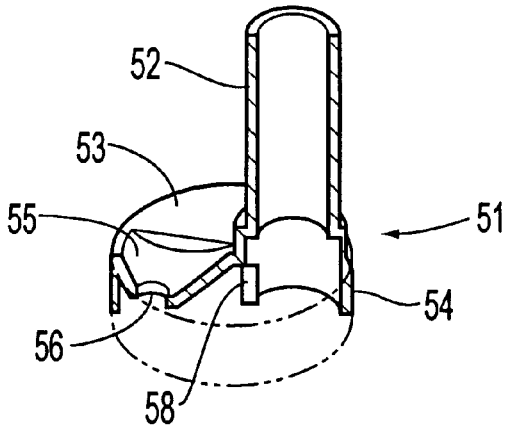
FIG. 4 is an enlarged perspective view showing another main member of the discharge container of FIG. 1 and taken in a longitudinal section.
Figure 5:
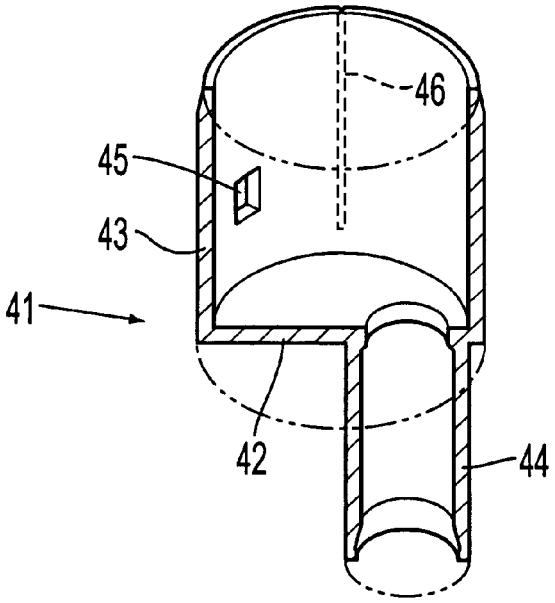
FIG. 5 is an enlarged perspective view showing still another main member of the discharge container of FIG. 1 and taken in a longitudinal section.
Figure 6:
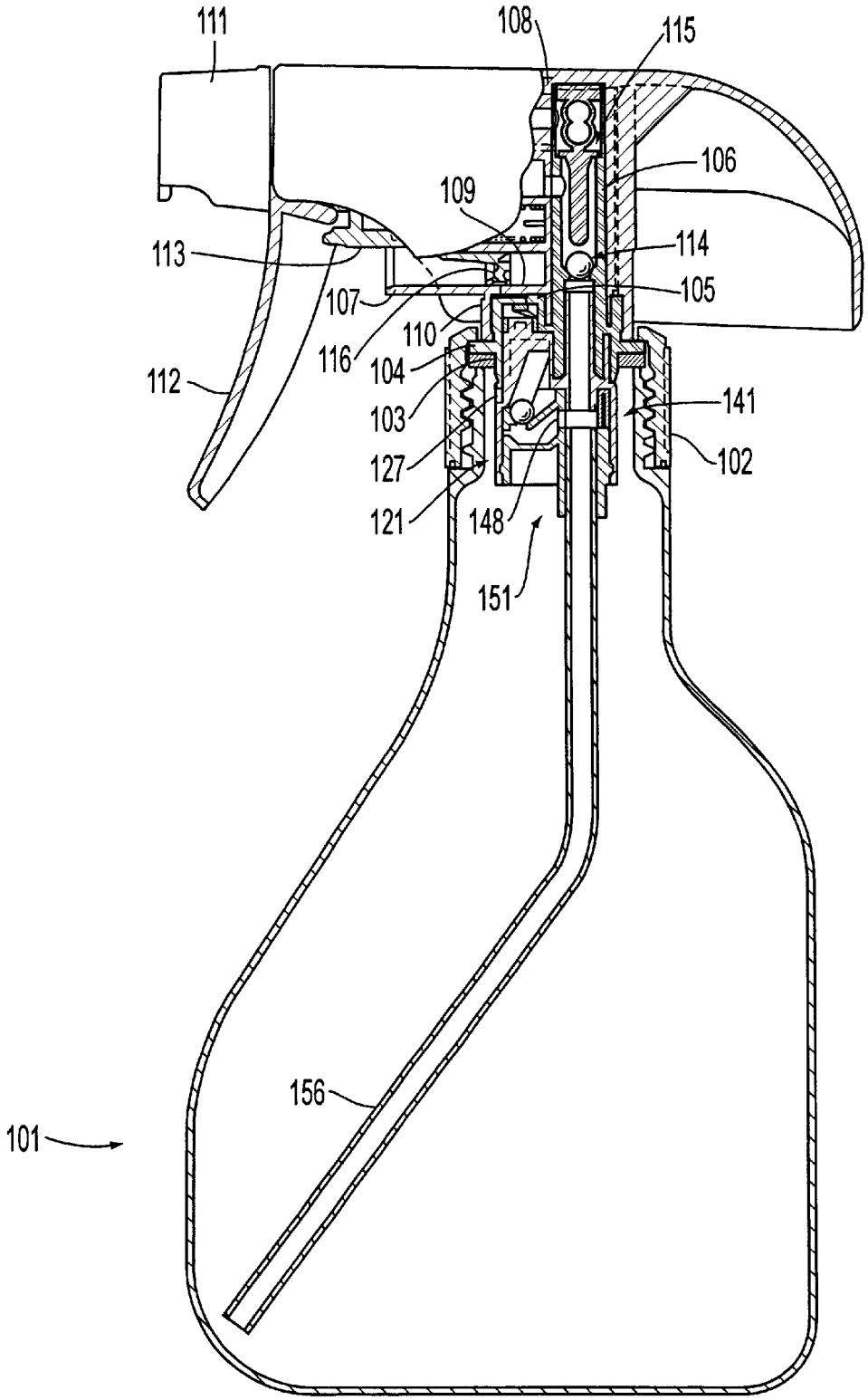
FIG. 6 is a section of a liquid discharge container according to a second embodiment.
Figure 7:
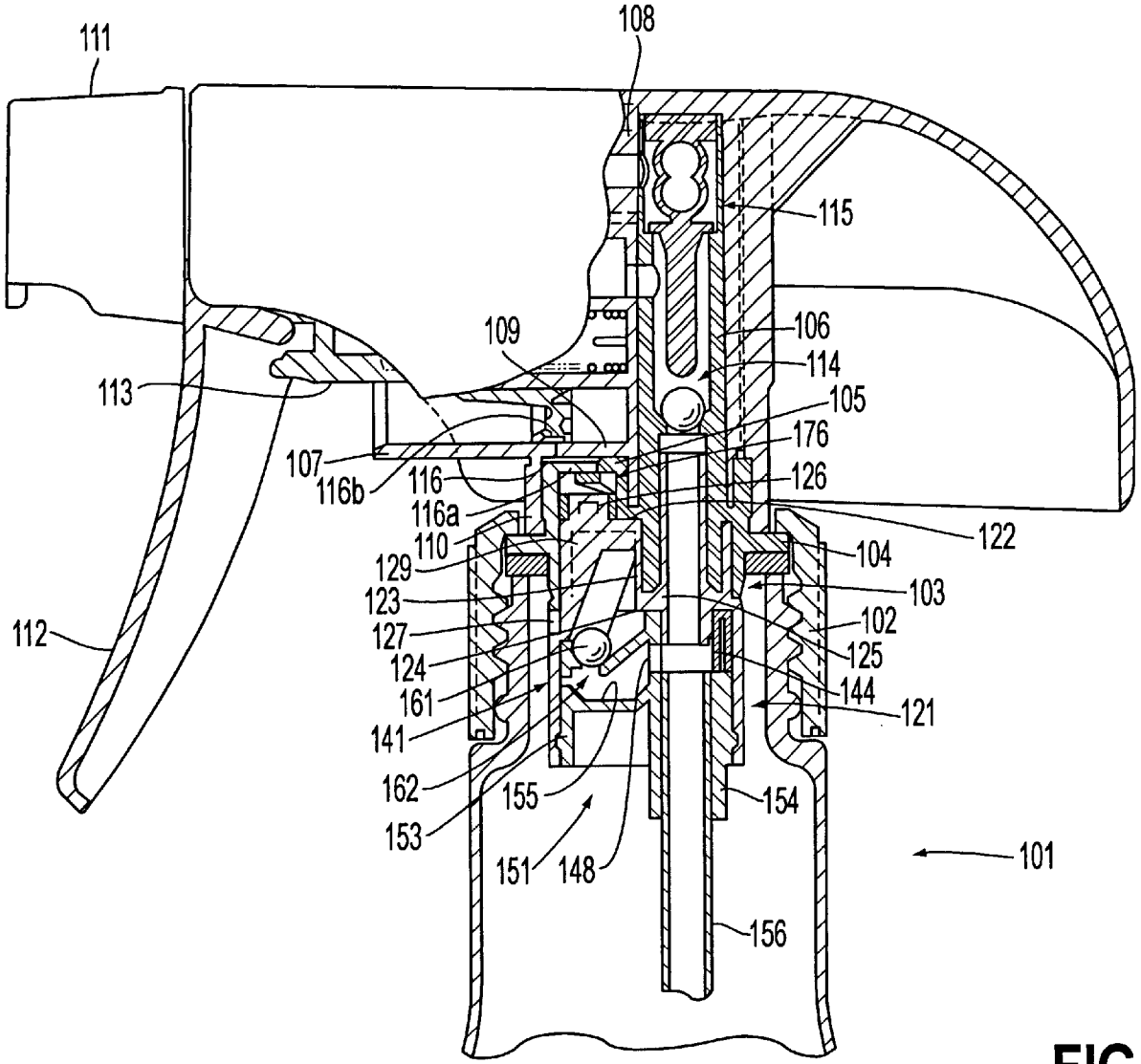
FIG. 7 is an enlarged section of an essential portion of FIG. 6.
Figure 8:
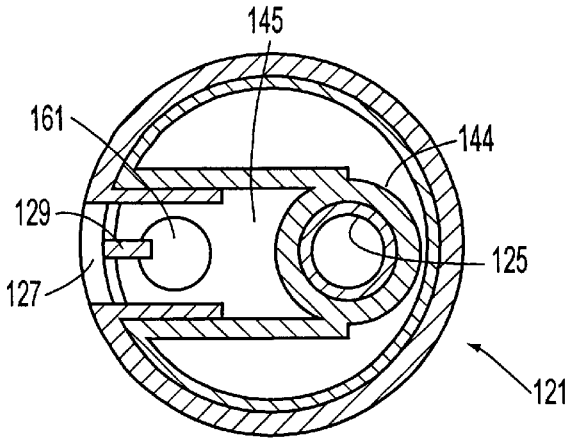
FIG. 8 is an enlarged transverse section of an essential portion of FIG. 6.

For the aforementioned ambient air supply passage, on the other hand, a second small hole 35 is formed, as shown in FIG. 3, in either of the righthand or lefthand side portion of the partition 31 of the first main member, and a longitudinal channel 46 is formed, as shown in FIG. 5, in either the inner face of the portion of the base tube 3 below the second small hole or in the outer face of the first circumferential wall 43 of the suction pipe setting tube 41. Thus, the ambient air supply passage into the container body is formed by the first small hole 17 formed in the front portion of the outwardly flanged wall 15 of the aforementioned second main member, the space in the portion of the base tube 3 over the partition 31, the second small hole 35 and the longitudinal channel 46. This ambient air supply passage may be partially clogged with a sheet having an air permeability but not a liquid permeability, or the supply passage may be partially formed of a small hole or channel having only the air permeability but not the liquid permeability so that it can desirably prevent the liquid from leaking therefrom in the inverted posture. The second small hole 35 and the longitudinal channel 46 are formed at positions circumferential spaced from the liquid inlet port 45 for the inverted posture so that the ambient air having entered the inside of the container body via the ambient air supply passage at the inverted time of the container body may not flow into the cylinder 13 through the liquid inlet port 45 for the inverted posture.

The portion of the first main member 2 under the outward flange 3*a* owned by the aforementioned base tube 3, the valved member 51 and the suction pipe setting tube 41 are positioned in the inner face of the neck portion of the container body and in a virtual space depending vertically from that inner face (i.e., a virtual space formed by extending the inner surface downwardly), when the mounting tube 21 is fastened on the outer face of the neck portion of the container body to fit the discharger body 1 in the container body 23. On the other hand, the liquid inlet port 45 for the inverted posture is positioned in the neck portion of the container body above the lower end face of the mounting tube 21.

The lower front part of the container body 23 may have a bulge 23*a* to a front direction as shown in FIG. 1, and the suction pipe 7 is positioned at its lower end in the lower portion of the bulge 23*a*.

With the construction thus far described, in the ordinary posture of the container, the liquid inlet port 45 for the inverted posture is positioned over the liquid level in the container body. However, at that time, the ball valve 57 shuts off the liquid passage for the inverted posture, which is formed of the liquid inlet port 45, the liquid inlet passage 34 for the inverted posture, the valve hole 56, the clearance between the lower face of the valve seat and the bottom plate 42, and the opening 58. As a result, the air over the liquid level does not flow via that passage into the joint tube 52 but is sucked, as in the case of the ordinary trigger-type liquid discharger, into the cylinder 13 through the suction pipe 7, the joint tube 52 and the suction tube 4, whereas the liquid in the cylinder is ejected through the ejection pipe 14.

When the container is inverted and triggered, the suction pipe 7 is exposed at its lower end over the liquid level by the inversion, and the ball valve 57 is moved over the valve chamber 32 to open the valve hole 56 so that the liquid inlet port 45 for the inverted posture is submerged into the liquid. On the other hand, the liquid in the suction pipe acquires the communication with the liquid in the container body via the aforementioned liquid passage for the inverted posture so that the liquid level in the inverted container body is substantially flush with the level of the liquid in the suction pipe. As the trigger 24 is squeezed from this state, the liquid in the container body is sucked into the cylinder 13 via the aforementioned liquid passage for the inverted posture so that the liquid in the cylinder is ejected out through the ejection pipe. Since the liquid in the suction pipe has communication with the liquid in the container body, as described above, it is not exclusively sucked when the liquid in the cylinder is sucked but is left at substantially the same level as that of the liquid in the container body. Although the suction pipe is exposed at its lower end over the liquid level, therefore, no risk is encountered by the fact that the air over the liquid level flows into the cylinder through the suction pipe.

In the present invention, the container body can eject the liquid even if it is held in a generally horizontal posture with the ejection pipe 14 being directed downward at its front end.

When the container body is held in the aforementioned generally horizontal posture, the ball valve leaves the valve seat 55 but stops when it contacts with the lower end portion of the slope 33.

When the liquid in the container body decreases so that the inside of the cylinder 13 is evacuated with the liquid level being below (or in front of, in the ordinary container posture) the liquid inlet port 45 for the inverted posture, the air over the liquid level is sucked through the inlet port 45. Since the ball valve 57 is stopped at a position close to the valve seat 55 while contacting with the lower end portion of the slope 33, however, the aforementioned air pushes the ball valve 57 onto the valve seat 55 to shut the valve hole so that no air flows in via the aforementioned liquid passage for the inverted posture. So long as the suction pipe 7 is submerged at its lower end in the liquid, therefore, the liquid is sucked into the cylinder through said suction pipe.

When the liquid level is over (or at the back of, in the ordinary container posture) the liquid inlet port 45 for the inverted posture, not the aforementioned air but the liquid flows in from that inlet port to push the ball valve 57 onto the valve seat 55 to shut the valve hole so that the liquid in the container body is sucked into the cylinder through the suction pipe 7.

Here will be described a second embodiment with reference to FIGS. 6 to 13. Reference numeral 101 designates a container body, and numeral 102 designates a mounting tube which is fastened on the outer face of the neck portion of that container body. A topped base tubular portion 103 having a smaller external diameter than that of the mounting tube is erected from the inside of the mounting tube by causing an outward flange 104, which is formed on the outer face of the lower portion of the base portion to be caught by the lower face of an inward flange formed on the upper end of the mounting tube. A main tube 106 is erected from the rear portion of a top wall 105 of the base tubular portion and has a lower portion extends through that top wall. In the shown embodiment, the main tube portion over the top wall is formed of two inner and outer tubes. A cylinder 107 is protruding forward from the front face of the outer tube, and an ejection pipe 108 is protruding forward from the upper end of the outer tube. An outwardly flanged wall 109 is provided at a lower portion of the outer tube, and has a lower rear wall portion of the cylinder as a common wall. A circumferential wall 110 is depending from the outer circumference of the outwardly flanged wall 109, and is fitted on the outer face of the upper portion of the aforementioned base tubular portion 103.

A nozzle tube 111 is turnably fitted through a joint tube on the front end portion of the aforementioned ejection pipe 108. On the other hand, a trigger 112 is turnably hinged and depending from the front end portion of the ejection tube. On the rear face of the upper portion of that trigger, there is retained the front end portion of a plunger 113 which is fitted in the aforementioned cylinder. Here, numeral 114 designates a suction valve, and numeral 115 designates a discharge valve. By the sliding motions of the plunger in the cylinder by the triggering operations, the liquid in the container body can be sucked into the cylinder through a suction pipe depending from the lower end of the aforementioned main tube, and the suction valve, and the liquid in the cylinder can be ejected from a nozzle hole of the nozzle tube through the discharge valve and the ejection pipe. Here, when the inside of the container body is evacuated as a result of the liquid ejection, this vacuum is eliminated by the communication between the ambient air and the inside of the base tubular portion 103 through that cylinder and an ambient air supply passage 116. The ambient air supply passage is formed by providing communication between a first hole 116*a* formed in the front portion of the top wall of the base tubular portion 103 and a second hole 116*b* formed in the bottom portion of the cylinder, and see to it that the second hole 116*b* is opened when the plunger 113 is moved backward by squeezing the trigger.

Figure 10:
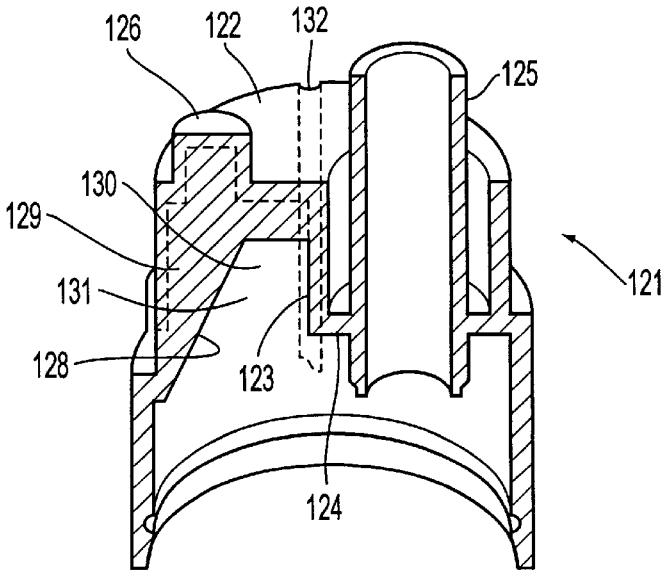
FIG. 10 is a perspective view showing a main member of FIG. 6 in a longitudinal section.

In the present invention, a liquid suction tube 121 depends from the inside of the aforementioned base tubular portion 103 while leaving a space in the upper portion of the same. A valved tube and a suction pipe setting tube as will be described hereinafter are fitted in the liquid suction tube 121. The liquid suction tube has a top plate 122 for shutting the upper surface of the liquid suction tube itself, a depending tube 123 depending from the rear portion of the top plate as shown in FIG. 10, and an inward flange 124 which is protruded from the lower end of the depending tube 123. The inner circumference of the inward flange is connected to the lower outer surface of the fitting tube 125. That fitting tube 125 and the depending tube 123 are formed into double tubes having the common axis. On the other hand, a short tube 126 having its upper face closed is erected by raising the top plate portion below the first hole 116*a*.

Figure 9:
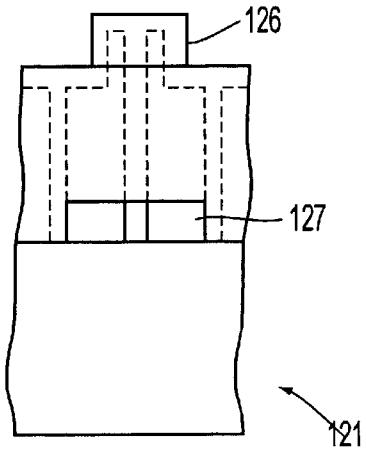
FIG. 9 is a front elevation of an essential portion of FIG. 6.

A liquid suction port 127 for the inverted posture is formed in the front portion of the liquid suction tube 121 at its uppermost position below the lower end of the base tubular portion 103, as shown in FIG. 9. A guide plate 129 is longitudinally formed from the widthwise center of liquid suction port at its lower end to towards the inside of the front of the base tubular portion above the suction port. The guide plate 129 has a rear face which is formed into a slope 128 inclined downward to the front. This guide plate 129 is extended at its upper portion into the aforementioned short tube and to the front face of the depending tube 123. A pair of side plates 130 and 130 are raised to a upper rear direction obliquely from the two right and left sides of the liquid suction port 127. These side plates define a valve chamber 131 together with the front face of the depending tube 123 at the back of those side plates.

Figure 11:
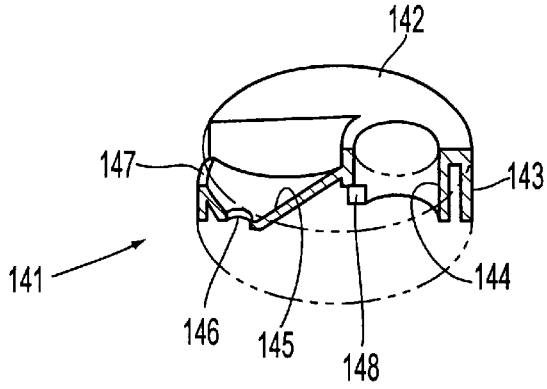
FIG. 11 is a perspective view showing a main member of FIG. 6 in a longitudinal section.

In a valved tube or a valve carrying tube 141, as shown in FIG. 11, a first outer tube 143 depends from the outer circumference of a first transverse wall 142, which is opened at its rear portion, and a first longitudinal tube 144 depends from the circumferential edge of that opening. A tapered valve seat 145 having a smaller diameter at its lower portion, is formed at the front portion of that transverse wall, and has a valve hole 146 at its lower end. As shown, the upper end portion of the first outer tube may preferably have, at its upper front portion of that valve seat, a notch 147 so as not to shut the liquid suction port 127 for the inverted posture. The first longitudinal tube 144 is also noted at the front portion of its lower end to form an opening 148.

Figure 12:
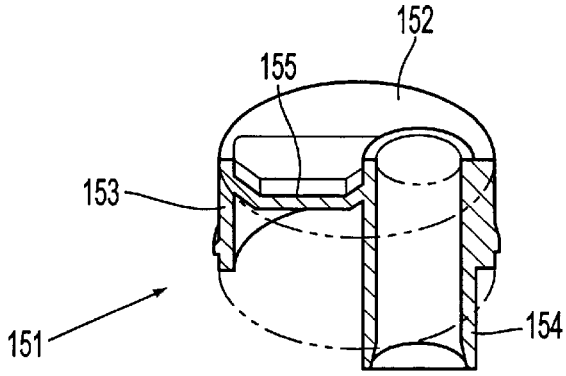
FIG. 12 is a perspective view showing a main member of FIG. 6 in a longitudinal section.

In a suction pipe setting tube 151, as shown in FIG. 12, a second outer tube 153 depends from the outer circumference of a second transverse wall 152, which is opened at its rear portion, and a second longitudinal tube 154 depends from the circumferential edge of that opening. In the shown embodiment, the second transverse wall has in its front portion an upper face which is formed into a recess 155, and a clearance is formed between the recess and the lower face of that portion of the first transverse wall, which has the aforementioned valve seat 145. A suction pipe 156 is tightly fitted at its upper portion in the second longitudinal tube 154.

In the shown embodiment, the fitting tube 125 of the liquid suction tube 121 for the inverted posture is fitted at its lower portion in the upper portion of the first longitudinal tube 144 of the valved tube 141, and the lower end face of the first longitudinal tube and the upper end face of the second longitudinal tube of the suction pipe setting tube 151 are made to contact liquid-tight with each other so that a liquid suction passage for the ordinary posture is formed of those suction pipe 156, second longitudinal tube 154, first longitudinal tube 144, fitting tube 125 and main tube 106.

A ball valve 161 is placed on the aforementioned tapered valve seat 145 to form an air suction preventing valve 162 for the ordinary posture, together with the valve hole 146 at the lower end of the valve seat. The slope 128 of the aforementioned liquid suction tube 121 is disposed at its lower end close to the front face of the upper portion of that ball valve 161.

Figure 13:
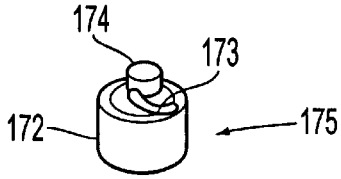
FIG. 13 is a perspective view of a main member of FIG. 6.

A valve member 175 is mounted on the outer face of the aforementioned short tube 126. The valve member 175 is provided with a valve plate 174 put on the tops of a plurality of elastic helical members 173 raised equidistantly from the upper end face of a tubular member 172, as shown in FIG. 13. This tubular member is fitted on the outer face of the short tube 126, and the valve plate 174 is urged onto the lower face of the first hole 116*a*, as formed in the front portion of the top wall of the base tubular portion 103, by the elasticity of the elastic helical members 173 to shut the first hole 116*a*. These valve plate and first hole construct an ambient air suction valve 176. When the inside of the container body is evacuated, the air opens the ambient air suction valve and enters the inside of the upper portion of the base tubular portion 103. This air flows into the container body via a channel 132 which is formed circumferentially apart from the liquid suction port 127 for the inverted posture and longitudinally in the outer face of the upper portion of the liquid suction tube 121, as shown in FIG. 10. Here, it is quite natural that the channel may be formed in the inner face of the base tubular portion 103.

The aforementioned container body 101 is largely bulged forward at its lower inside with respect to the center axis of its trunk portion, and the suction pipe 156 is bent downward and forward from its intermediate portion so that the liquid suction port for the ordinary posture, as formed at its lower end, is positioned close to the front end portion of the bottom wall of the container body.

In the shown embodiment, the liquid suction passage for the ordinary posture is formed of the suction pipe 156, the second longitudinal tube 154, the first longitudinal tube 144, the fitting tube 125 and the main tube 106. For example, however, the first longitudinal tube 144 can be extended upward and fitted directly in the lower portion of the main tube to form the aforementioned liquid suction passage for the ordinary posture. In the shown embodiment, on the other hand, the liquid suction passage for the inverted posture is formed of the liquid suction port 127 for the inverted posture, the valve chamber 131, the valve hole 146, the clearance between the first and second transverse walls 142 and 152, and the opening 148 formed in the first longitudinal tube 144. However, that opening 148 need not be formed in the first longitudinal tube 144 but can naturally be formed in the extended tubular portion which is extended upward from the second longitudinal tube 154 of the suction pipe setting tube.

Here, the aforementioned ambient air suction valve 176 may be provided, if necessary, as well as the forward bulge of the lower part of the container body and the forward bend of the suction pipe 156.

As in the foregoing first embodiment, the portion of the base tubular portion 103 under the outward flange 104, the liquid suction tube 121 for the inverted posture, the valved tube 141, and the suction pipe setting tube 151 are positioned in the inner face of the neck portion of the container body and in a virtual space extended downward from that inner face when the mounting tube 102 is fastened on the outer face of the neck portion of the container body. On the other hand, the liquid suction port 127 for the inverted posture is positioned in the portion of the neck portion of the container body over the lower end face of the mounting tube 102.

With the construction thus far described, the container body is charged with a proper amount of liquid and is triggered in its ordinary posture. Then, the liquid suction port 127 for the inverted posture is opened over the liquid level in the container body, but the air suction preventing valve 162 for the ordinary posture is disposed midway of the liquid suction passage for the inverted posture leading from that suction port to the opening 148 so that the air over the liquid level does not enter the cylinder via the liquid suction passage for the inverted posture. As in the ordinary trigger-type liquid discharge container, therefore, the liquid in the container body is sucked into the cylinder via that liquid suction passage for the ordinary posture and through the suction valve 114, and the liquid in the cylinder is ejected through the discharge valve 115 from the nozzle tube at the front end of the ejection pipe by the high pressure which is established in the cylinder as the plunger is moved backward.

When the container body is then inverted, the suction pipe 156 is exposed at its lower end to over the liquid level, and the liquid suction port 127 is submerged in the liquid. On the other hand, the ball valve 161 is moved upward in the valve chamber 131 by its own weight so that the air suction preventing valve 162 for the ordinary posture is opened.

When the inside of the cylinder 107 is evacuated by the triggering operation in this state, the liquid having entered the liquid suction passage for the ordinary posture from the opening 148 via the aforementioned liquid suction passage for the inverted posture is sucked into the cylinder 107 and is ejected from the nozzle tube through the discharge valve 115, which is opened by the high pressure in the cylinder as the plunger is moved backward, and through the ejection pipe. Here, although the suction pipe 156 is exposed at its lower end to over the liquid level, the liquid having flown into the pipe has communication with the liquid in the container body via the liquid suction passage for the inverted posture so that the level of the liquid in the suction pipe and the level of the liquid in the container body are substantially flush with each other, At the liquid suction into the cylinder, therefore, no air flows into the cylinder via the aforementioned suction pipe. When the liquid decreases at the using time in the inverted posture to evacuate the inside of the container body, the ambient air supply passage 116 and the ambient air suction valve 176 are opened as a result of the backward movement of the plunger 113. The ambient air thus introduced into the upper portion of the base tubular portion 103 flows through the channel 132 which is longitudinally formed in the outer face of the upper portion of the liquid suction tube 121 for the inverted posture so that it rises as bubbles in the liquid until it is released over the liquid level to relieve the aforementioned vacuum state. Here, that channel 132 is formed circumferentially apart from the liquid suction port 127 for the inverted posture so that the aforementioned bubbles are not sucked together with the liquid sucked from that liquid suction port 127.

The discharge container according to the present invention can discharge the liquid, even when the ejection pipe 108 is directed downward with the container body being in a generally horizontal posture.

More specifically, the liquid suction port 127 for the inverted posture is then opened downward (or sideway, in the ordinary posture), and the ball valve 161 of the air suction preventing valve 162 for the ordinary posture leaves the valve seat 145 but stops in contact at the front face of its upper portion with the lower end of the slope 128 of the front face of the valve chamber 131. At this time, the container is put into the horizontal posture, with its lower trunk portion, which bulges forward in ordinary posture, turning to bulge downward, and the lower end of the suction pipe 156 is also positioned in the said downward bulging portion. If the liquid level in the container body is higher in the horizontal state of the container body than the aforementioned liquid suction port 127 for the inverted posture, therefore, those two liquid suction ports are submerged together in the liquid so that the liquid can be discharged by the triggering operation.

When the liquid further decreases in the horizontal state of the container body so that the liquid level in the container body comes to a position below the liquid suction port 127 for the inverted posture, the air in the container body seems to be sucked from the liquid suction port 127 as the inside of the cylinder is evacuated. However, since the ball valve 161 is positioned in contact with the slope 128 and close to the valve seat 145, the ball valve 161 is sucked by the valve hole 146 simultaneously with the aforementioned air suction to shut the aforementioned air suction preventing valve 162 for the ordinary posture, so that the liquid in the container body is sucked via the liquid suction passage for the ordinary posture.

Figure 14:
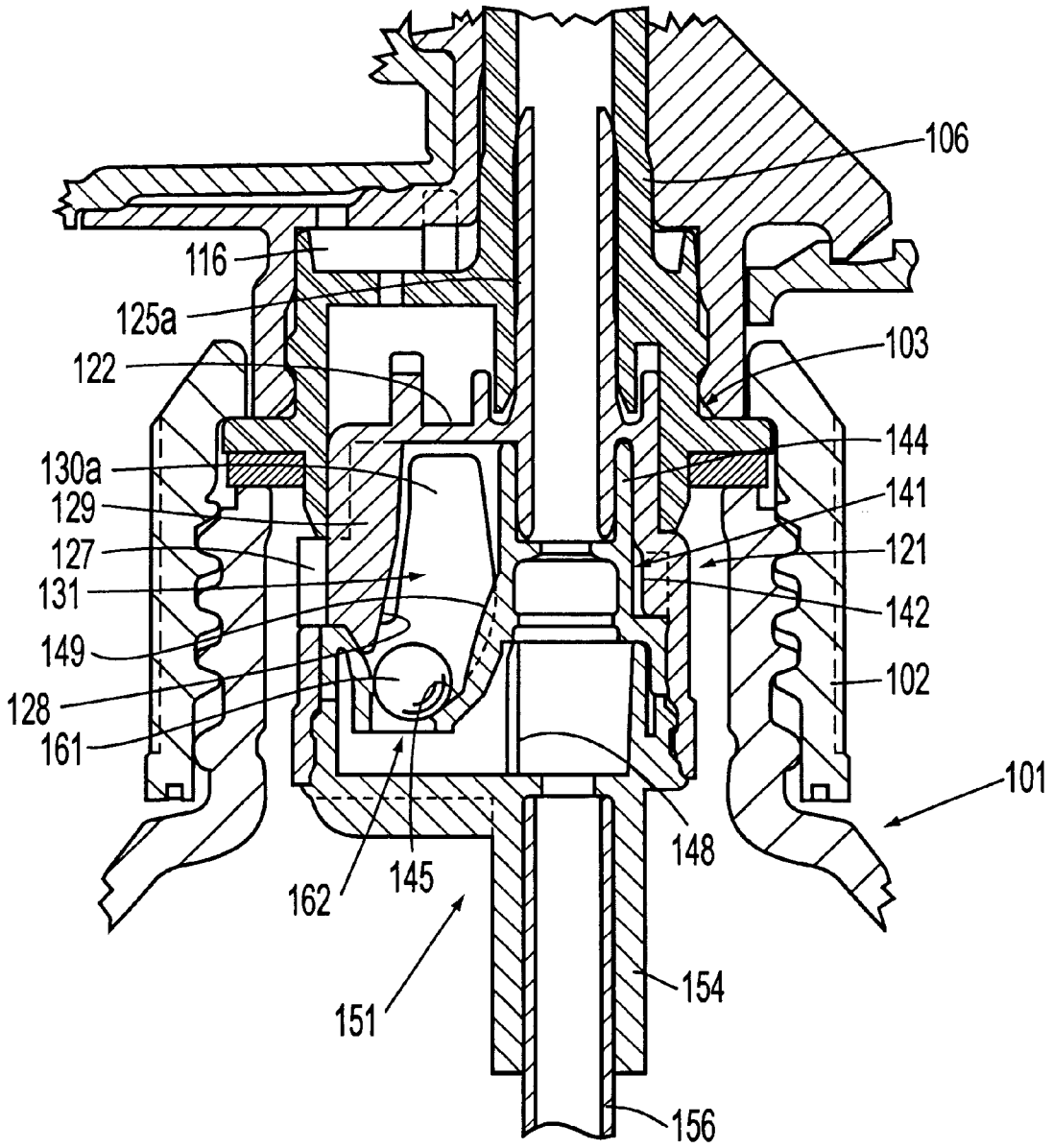
FIG. 14 is an enlarged view showing an essential portion of a third embodiment.

FIG. 14 shows a third embodiment. This embodiment is changed mainly in the portion of the liquid suction tube 121 for the inverted posture and in the portion of the valved tube 141 of the foregoing second embodiment, and the description of the unchanged portions will be omitted by designating them by the common reference numerals. The liquid suction tube 121 for the inverted posture has a rising tube **125*a* extending from and penetrating through the rear portion of the top plate 122 shutting the upper face of the liquid suction pipe, while fitting the upper portion of the rising tube 125*a* liquid-tight in the lower portion of the main tube 106. On the other hand, the valved tube 141 has the first transverse wall 142 shutting its upper face and having an opening in the rear portion thereof. From the circumferential edge of the opening, the first longitudinal tube 144 is raised, while the upper portion of which is fitted liquid-tight on the outer face of the lower portion of the rising tube 125*a*. On the other hand, a longitudinal ridge 149 sloped to an upper rear direction is formed from the inner face of the rear portion of the valve seat 145 to the front face of the lower portion of the first longitudinal tube 144. From the two right and left sides of the upper edge of the valve seat 145, moreover, there are raised side plates 130*a* and 130*a* to replace the side plates 130 and 130** of the second embodiment.

In this embodiment, the valve chamber 131 is formed by the valve seat 145 owned by the valved tube 141, the front face of the first longitudinal tube 144, the side plates 130*a* and 130*a*, the lower face of the front portion of the top plate 122 owned by the liquid suction tube 121 for the inverted posture, and the guide plate 129.

The actions are identical to those of the second embodiment so that their description will be omitted.

Figure 15:
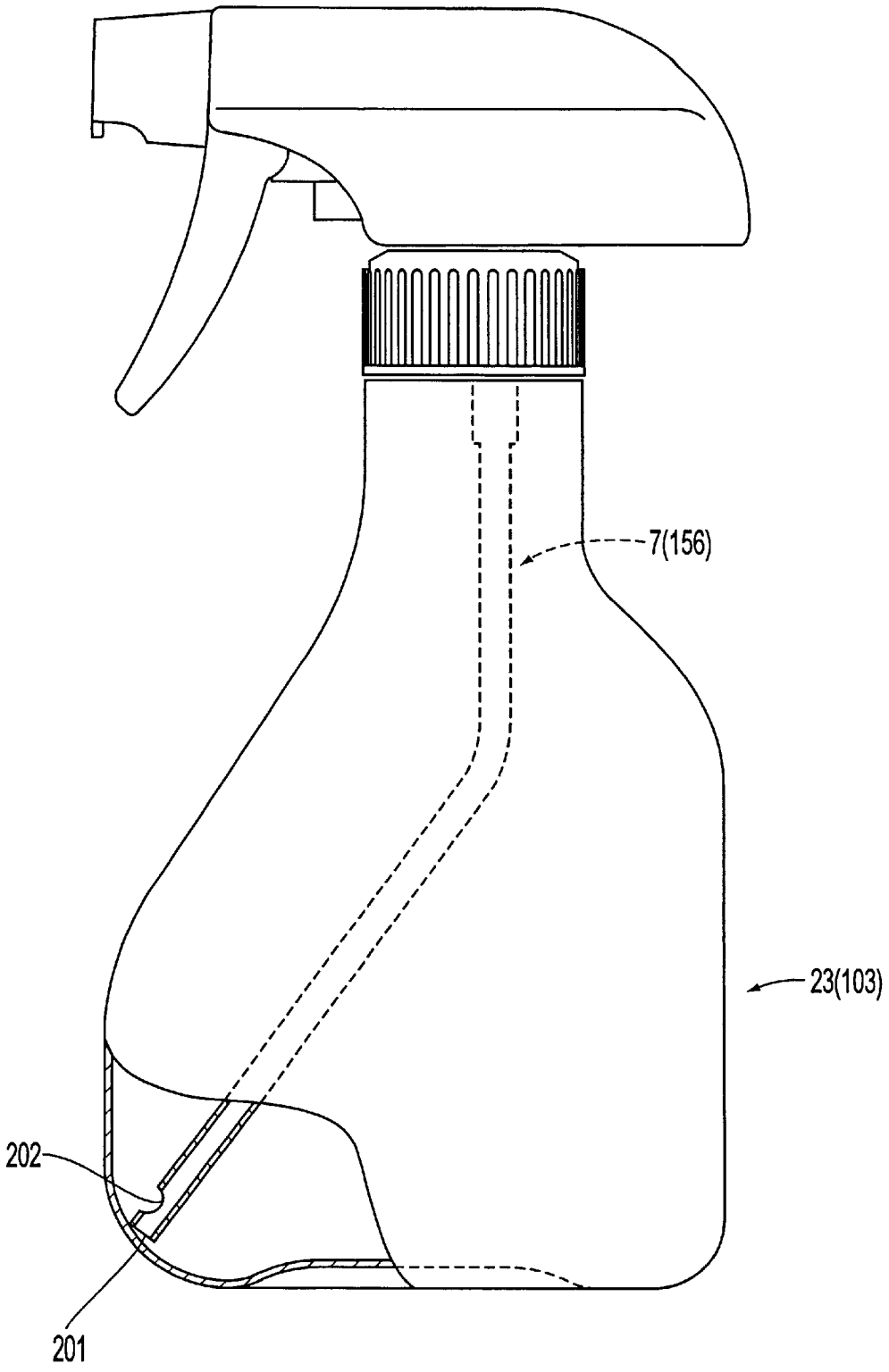
FIG. 15 is a partially sectional view showing a modification of a suction pipe of the individual embodiments.

FIG. 15 shows an example in which a substituting ambient air suction port 202 is formed in the lower portion of the suction pipe, as used in the foregoing first, second and third embodiments, and close to a lower end opening 201 of the suction pipe.

Here will be described the reason why that hole is formed. When the liquid in the container body is exhausted by ejecting the liquid, the discharger is removed and is then mounted again after the container body is supplied therein with the liquid. However, there may arise a risk that when the discharger is removed, as above, the suction pipe may contact at its lower end with another object to contaminate it with the liquid wetting the lower end of the pipe. Against this risk, the discharger is frequently turned into the inverted posture or the horizontal posture. Although the suction pipe depends while the discharger is in the ordinary posture, the liquid suction passage for the inverted posture and the liquid discharge passage for providing the communication between the upper end of the suction pipe and the ambient air are shut by the air suction preventing valve for the ordinary posture and by the suction itself. As a result, no air can enter the pipe so that a surface tension acts on the lower end face of the pipe. As a result, the liquid in the pipe will not drop by its own weight even if the lower end of the pipe is merely extracted from the liquid.

When the discharger is turned to the inverted posture or the horizontal posture, however, the aforementioned air suction valve for the ordinary posture is opened to open the liquid suction passage for the inverted posture so that the substituting ambient air flows in from the opening of the lower end of the pipe and out into the mounting tube 102 via the liquid suction passage for the inverted posture. Then, at the remounting time of the discharger, the liquid having occupied the mounting tube flows down along the outer face of the neck portion of the container body thereby to contaminate the surroundings.

By forming the substituting ambient air suction port 202 in the lower portion of the suction pipe close to the lower end opening 201, as shown in FIG. 15, simultaneously as the lower end opening of the suction pipe is caused to leave the liquid surface by removing the discharger, the substituting air flows into that pipe so that the liquid in the pipe drops into the container body by its own weight. Accordingly, the liquid is not left in the suction pipe when this pipe is extracted to the outside of the container body.

INDUSTRIAL APPLICABILITY

The present invention has the construction thus far described. In the invention according to the aforementioned first means, the correspondent of a three-way branch pipe member in the aforementioned prior art is formed by fitting the first circumferential wall 43 of the suction pipe setting tube 41 in the lower portion of the base tube 3 forming the lower portion of the discharge body, and by fitting the valved member 51 between those base tube and suction pipe setting tube 41. As a result, the corresponding three-way branch pipe member in the present invention can be formed in contact with the lower face of the discharge body so that said three-way branch pipe member corresponding portion raises no obstruction unlike the prior art when it is attached to or detached from the container body. Since the upper portion of the first circumferential wall 43 is fitted in the inner face of the lower portion of the base tube 3, on the other hand, the lower portion of this base tube 3 can be a part of the corresponding three-way branch pipe member, so that a joint between the first main member and the three-way branch pipe member can be integrally reinforced more than the example of the prior art in which the upper portion of the main tube of the three-way branch tube member is merely fitted in the lower portion of the suction tube 4. Since the valve chamber 32 depends from the front portion of the partition of the base tube 3, on the other hand, it is not necessary to provide another member carrying the valve, so that the number of parts may be reduced. Moreover, since the front wall face of the valve chamber is formed into the slope 33 inclined to a upper rear direction from its lower end so that its lower end is positioned close to the front face of the upper portion of the ball valve 57 placed on the valve seat, the ball valve 57 is stopped at a position contacting with the rear face of the lower end of that slope and slightly spaced from the valve seat even if the container body is positioned so substantially horizontally that the front end of the ejection pipe 14 is directed downward. In said horizontal posture, therefore, the air or liquid, which has flown into the valve chamber 32 via the liquid inlet port 45 for the inverted posture and the liquid inlet passage 34 for the inverted posture and which is going to pass through the valve hole 56, pushes the ball valve 57 onto the valve seat 55 to shut the valve hole so that the liquid can be discharged even when the container body takes the horizontal posture.

As in the aforementioned second means, on the other hand, the liquid inlet port 45 for the inverted posture is formed over the front portion of the first circumferential wall 43, and moreover, the second small hole 35 is formed in either of the right or left side portion of partition 31 of the first member circumferentially apart from the liquid inlet port 45, and furthermore, the longitudinal channel 46 is formed in either the inner face of the base tube or the outer face of the first circumferential wall below the second small hole, so that the ambient air supply passage is formed by causing them to communicate with the first small hole 17 which is formed in the front portion of the outwardly flanged wall 15 of the second main member. In the inverted posture of the container body, therefore, the ambient air to flow into the container body via that ambient air supply passage is not sucked from the liquid inlet port 45 for the inverted posture.

In the invention according to the aforementioned third means, on the other hand, the valved tube 141 and the suction pipe setting tube 151 are fitted, respectively, in the intermediate portion and in the lower portion of the liquid suction tube 121 for the inverted posture, in which the depending tube 123 depends from the top plate 122, and the upper portion of the liquid suction tube 121 for the inverted posture is fitted into the base tubular portion 103 of the trigger-type liquid discharger of the prior art, while and the lower portion of the main tube 106 is fitted the depending tube 123. As a result, those three members can be fitted compactly and integrally and can be attached reliably and safely to the base tubular portion. On the other hand, the liquid suction passage for the ordinary posture can be easily formed by providing communication between the suction pipe 156 depending from the second longitudinal tube and the main tube 106 through the first longitudinal tube 144 and the second longitudinal tube 154 which are penetrating respectively, through the first and second transverse walls 142 and 152 owned by said valved tube 141 and said suction pipe setting tube 151.

The tapered valve seat 145 having a smaller diameter at its lower portion is provided at the front portion of the first transverse wall of the valved tube close to the lower edge of the liquid suction port 127 for the inverted posture, which is formed in the front portion of the liquid suction tube 121 for the inverted posture, and the slope 128 inclined to an upper rear direction is formed close, at its lower end, to the front face of the upper portion of the ball valve 161 placed on said valve seat. On the other hand, the valve chamber 131 is formed to surround over the side portion of the ball valve 161, and its front face is formed by the aforementioned slope. Even when the ejection tube is directed downward at its front portion so that the container body is in the generally horizontal posture, therefore, the ball valve 161 is stopped in contact with the lower end of the aforementioned slope and at the position close to the valve seat 145. As a result, the air suction preventing valve 162 for the inverted posture can act even with said container body being in the horizontal posture, so that the liquid can be discharged when said container body takes the horizontal posture.

As in the aforementioned fourth means, on the other hand, the upper portion of the first longitudinal tube 144 is fitted on the outer face of the lower portion of the rising tube 125*a*, and the upwardly inclined longitudinal ridge 149 is formed from the inner face of the rear portion of the valve seat 145 to the front face of the lower portion of the first longitudinal tube 144. As a result, the ball valve 161 can be moved easily and reliably into the upper portion of the valve chamber when the container body takes the inverted posture.

As in the aforementioned fifth means, the first hole 116*a* is formed as the exit hole of the ambient air supply passage 116 to communicate with the inside of the cylinder is formed in the front portion of the top wall 105 of the base tubular portion 103 and is shut by forcing the valve plate 174 of the valve member 175, as fitted on the short tube 126 raised from the top wall of the base tubular portion, to contact with the lower face of the first hole 116*a*, so that the liquid can be prevented from leaking from the first hole 116*a* when the container is used in the inverted posture. Moreover, in this invention, the channel 132 is longitudinally formed either in the outer face of the upper portion of the liquid suction tube 121, as circumferentially spaced from the liquid suction port 127 for the inverted posture, or in the inner face of the base tubular portion 103 opposed to the outer face of the suction tube 121, such that the channel can guide the ambient air which enters into the upper portion of the base tubular portion 103 from the first hole, to flow into the container body. As a result, the ambient air, which passes through the channel at the time of using the container body for the inverted posture and goes up as bubbles over the liquid surface of the container body, can be prevented from being sucked into the cylinder, together with the liquid which is sucked from the aforementioned liquid suction port 127 for the inverted posture.

As in the aforementioned sixth means, on the other hand, the liquid inlet port 45 for the inverted posture or the liquid suction port 127 for the inverted posture is positioned in the neck portion of the container body above the lower end of the mounting tube 21 or 102. Even when the liquid in the container body decreases so that the liquid level for the container body in the inverted posture becomes flush with the lower end face of the mounting tube, therefore, the liquid can be discharged when said container body is in the inverted posture.

As in the aforementioned seventh means, on the other hand, the liquid in the container body can be used substantially to the last droplet by bulging the lower portion of the trunk portion of the container body largely forward, by bending the suction pipe downward and forward and by positioning the lower end of the suction pipe above the front end portion of the bottom wall of the container body.

As in the aforementioned eighth means, on the other hand, the substituting ambient air suction port 202 is formed in the lower portion of said suction pipe close to the lower end opening 201 thereof. When the discharger is removed and lifted up for supplying the inside of the container body with the liquid, simultaneously as the lower end of the suction pipe leaves the liquid surface of the container body, the substituting ambient air flows into the pipe so that the liquid in said pipe flows down into the container body by its own weight. As a result, the liquid in the suction pipe of the discharger, as removed from the container body, flows into the mounting tube. When the discharger is to be mounted, on the other hand, the liquid in that mounting tube can be prevented from flowing out along the outer face of the neck portion of the container body.

What is claimed is:

1. A trigger-type liquid discharge container usable in both ordinary and inverted postures, comprising a container body with a neck portion, a discharge body (1) and a mounting tube (21) said discharge body including:

a first main member (2) having a suction tube (4) raised from an inside of a rear portion of a base tube (3);

and a second main member (11) having an outer tube (12) fitted on an outer face of said suction tube, a cylinder (13) protruding forward from a lower portion of the outer tube (12) an ejection pipe (14) protruding forward from an upper end portion of the outer tube (12) each said cylinder and ejection pipe communicating with the suction tube respectively, an outwardly flanged wall (15) which is formed on the lower portion of said outer tube and has a rear bottom wall portion of said cylinder as a common wall, a cover tube (16) depending from an outer circumference of the outwardly flanged wall (15) and being fitted on an upper outside of said base tube (3);

said base tube (3) having at an intermediate portion on which an outward flange (3*a*) is provided;

said mounting tube (21) depending turnably from an inward flange (22), which is formed on an upper end of the mounting tube (21) and resting on a rim of the outward flange (3*a*), and said mounting tube being fastened on an upper face of the neck portion of the container body; characterized:

in that said first main member (2) is further defined by that said base tube (3) has an open top, and a partition (31) is transversely provided in the intermediate portion of the base tube (3) and said suction tube (4) extends upwardly from a rear part of said partition (31) while a lower part of said suction tube (4) penetrating downwardly therethrough;

in that said discharge container also comprises a suction pipe setting tube (41) having a bottom plate (42) and a first circumferential wall (43) which extends upwardly from an outer circumference of the bottom plate (42) and has a upper wall portion fitted watertightly into a lower portion of the said base tube (3), and a suction pipe (7) which depends downward from a rear portion of said bottom plate (42) while the suction pipe is opened to an upper face of said bottom plate;

in that said discharge container further comprises a valved member (51) having a top plate (53), a second circumferential wall (54) which depends from an outer circumference of the top plate (53) and is fitted in a lower portion of said first circumferential wall (43), and a joint tube (52) which extends upwardly from a rear portion of the top plate (53) and penetrates downwardly therethrough, while an upper portion of said joint tube (52) being fitted into the lower part of the suction tube (4), while the joint tube is communicating with the suction pipe (7), said top plate having a front portion which is formed into a valve seat (55) tapering to have a small diameter lower end portion, in which a valve hole (56) is provided, while a ball valve (57) being placed on the tapered valve seat, and the joint tube (52) having below the top plate (53) an opening (58) communicating with the valve hole (56);

in that a valve chamber (32) having a lower face opened is extending downward from a front portion of the partition (31) of the first main member to an area above the ball valve (57), while a liquid inlet port (45) for the inverted posture is opened at an upper front portion of the first circumferential wall (43), and a liquid inlet passage (34) for the inverted posture is formed for communicating the valve chamber and the liquid inlet port, and a front wall face in the valve chamber is formed into a slope (33) having a lower end, from which the slope is inclined towards an upper back direction, while the lower end of said slope being close to an upper front face of the ball valve (57).

2. A trigger-type liquid discharge container usable in both ordinary and inverted postures as set forth in claim 1, characterized:

in that a first small hole (17) is formed in a front portion of the outwardly flanged wall (15) of the second main member (11), a second small hole (35) is formed in either of a right or left side portion of the partition (31) of the first main member circumferentially apart from the liquid inlet port (45) for the inverted posture, and a longitudinal channel (46) is formed in either the inside of the base tube (3) or an outer face of the first circumferential wall (43) below the second small hole, so that an ambient air supply passage for supplying the ambient air into the container body is formed of said first small hole (17), a space in a portion of the base tube (3) above the partition, said second small hole (35), and said longitudinal channel (46).

3. A trigger-type liquid discharge container usable in both ordinary and inverted postures, comprising a container body with a neck portion, a mounting tube fitted on the neck portion, a base tubular portion including a top wall and having a smaller external diameter than that of the mounting tube, said base tubular portion erecting from an inside of an upper part of the mounting tube, a main tube erecting from and penetrating through the top wall of the base tubular portion, a cylinder protruding forward from a front face of the main tube, an ejection pipe protruding forward from a top end of the main tube, a trigger which is hinged to and depending from a front portion of the ejection pipe, a plunger which is fitted in the cylinder and has an front portion engaged with an upper rear portion of the trigger, characterized:

in that the discharge container further includes a liquid suction tube (121) for the inverted posture having an upper portion which is fitted into said base tubular portion (103) while leaving a space in an upper portion of said base tubular portion, a valved tube (141) which is fitted in an intermediate portion of said liquid suction tube (121), and a suction pipe setting tube (151) which is fitted in a lower inner surface of said liquid suction tube (121);

in that said liquid suction tube (121) includes a depending tube (123), depending from a top plate (122) which shuts off an upper surface of the liquid suction tube, while said valved tube (141) has a first transverse wall (142) through which a first longitudinal tube (144) is penetrating, and said suction pipe setting tube (151) has a second transverse wall (152) through which a second longitudinal tube (154) is penetrating, and that a liquid suction passage for the ordinary posture is provided by fitting a lower end portion of said main tube (106) water-tightly in the depending tube (123), and by communicating the main tube (106) and a suction pipe (156) depending from the second longitudinal tube (154) through the first and second longitudinal tubes (144) and (154);

in that the liquid suction tube (121) for the inverted posture has a tubular part which depends below a lower end of said base tubular portion (103), and has at a front upper end of said tubular part a liquid suction port (127) for the inverted posture, while the first transverse wall (142) of the valved tube (141) has a front portion which is formed into a tapered valve seat (145) in a vicinity of a lower edge of said liquid suction port (127), said tapered valve seat (145) having a small diameter lower portion and receiving a ball valve (161) thereon to form an air suction preventing valve (162) for the ordinary posture, while a valve chamber (131) is formed around an upper side of said ball valve (161), a front face of said valve chamber being formed into a slope (128) which is inclined to an upper rear direction so as to keep a lower end of the slope (128) close to a front upper part of the ball valve (161), and;

in that an opening (148) is formed in a front portion of the first or second longitudinal tube between the first transverse wall (142) of the valved tube and the second transverse wall (152) of the suction pipe setting tube, to provide a communication between a valve hole (146) at a lower end of said valve seat and the liquid suction passage.

4. A trigger-type liquid discharge container usable in both ordinary and inverted postures, comprising a container body with a neck portion, a mounting tube fitted on the neck portion, a base tubular portion including a top wall and having a smaller external diameter than that of the mounting tube, said base tubular portion tube erecting from an inside of an upper part of the mounting tube, a main tube erecting from and penetrating through the top wall of the base tubular portion, a cylinder protruding forward from a front face of the main tube, an ejection pipe protruding forward from a top end of the main tube, a trigger which is hinged to and depending from a front part of the ejection pipe, a plunger which is fitted in the cylinder and has a front portion engaged with an upper rear portion of the trigger, characterized:

in that the discharge container further includes a liquid suction tube (121) for the inverted posture having an upper portion which is fitted into said base tubular portion (103) while leaving a space in an upper portion of said base tubular portion, a valved tube (141) which is fitted in an intermediate portion of said liquid suction tube (121), and a suction pipe setting tube (151) which is fitted in a lower inner surface of said liquid suction tube (121);

in that said liquid suction tube (121) having an upper surface being shut off by a top plate (122) includes a rising tube **(125*a*) penetrating through a rear portion of the top plate (122) and having an upper portion which is fitted water-tightly into a lower portion of the main tube (106), while said valved tube (141) has a first transverse wall (142) having a rear portion provided with an aperture from which circumference a first longitudinal tube (144) is standing, an upper part of said first longitudinal tube being fitted on a lower outer face of said rising tube (125*a*) and said suction pipe setting tube (151) has a second transverse wall (152) having a rear portion through which a second longitudinal tube (154) is penetrating, and that a liquid suction passage for the ordinary posture is provided by communicating the main tube (106) and a suction pipe (156) depending from the second longitudinal tube (154) through the first and second longitudinal tubes (144) and (154) and the rising tube (125*a*)**;

in that the liquid suction tube (121) for the inverted posture has a tubular part which depends below a lower end of said base tubular portion (103), and has at a front upper end of said tubular part a liquid suction port (127) for the inverted posture, while the first transverse wall (142) of the valved tube (141) has a front portion which is formed into a tapered valve seat (145) in a vicinity of a lower edge of said liquid suction port (127) said tapered valve seat (145) having a small diameter lower portion and receiving a ball valve (161) thereon to form an air suction preventing valve (162) for the ordinary posture, while a valve chamber (131) is formed around an upper side of said ball valve (161), a front face of said valve chamber being formed into a slope (128) which is inclined to an upper rear direction so as to keep a lower end of the slope (128) close to a front upper part of the ball valve (161), and a longitudinal ridge (149) sloped to an upper rear direction is formed from an inside of a rear portion of the valve seat (145) to a lower front face of the first longitudinal tube (144);

in that an opening (148) is formed in a front portion of the first or second longitudinal tube between the first transverse wall (142) of the valved tube and the second transverse wall (152) of the suction pipe setting tube, to provide a communication between a valve hole (146) at a lower end of said valve seat and the liquid suction passage.

5. A trigger-type liquid discharge container usable in both ordinary and inverted postures as set forth in claim 3; characterized:

in that a first hole **(116*a*) is formed in a front portion of the top wall (105) of the base tubular portion as an exit hole of an ambient air supply passage (116) communicating with an inside of the cylinder, and a portion of the top wall of the base tubular portion under said first hole is raised to form a short tube (126)** having a closed upper face;

in that the discharge container further comprises a valve member (175) having a tubular member (172) with an upper end face from which a plurality of elastic helical members (173) are raised equidistantly, while a valve plate (174) being provided at upper ends of the plurality of elastic helical members, so that a lower face of the first hole is shut by fitting said tubular member on an outer face of the short tube (126) and by forcing the valve plate (174) to contact with the first hole;

in that the discharge container also comprises a channel (132) for communicating a space in the upper portion of the base tubular portion and an inside of the container body, said channel is longitudinally formed, spaced circumferentially from said liquid suction port for the inverted posture, either in an upper outer face of the liquid suction tube (121) for the inverted posture or in an inner face of the base tubular portion (103) as opposed to the upper outer face of the liquid suction tube.

6. A trigger-type liquid discharge container usable in both ordinary and inverted postures as set forth in claim 1, characterized:

in that the liquid inlet port (45) for the inverted posture or the liquid suction port (127) for the inverted posture is positioned in the neck portion of the container body above a lower end of the mounting tube (21) or (102).

7. A trigger-type liquid discharge container usable in both ordinary and inverted postures as set forth in claim 1, characterized:

in that said container body has a trunk portion, a lower part of which is largely bulged forward with respect to a center axis of the truck portion, whereas the suction pipe (7) or (156) is bent towards a lower front direction to bring a lower end of the suction pipe close to a front end of a bottom wall of the container body.

8. A trigger-type liquid discharge container usable in both ordinary and inverted postures as set forth in claim 1, characterized:

in that the suction pipe, depending from the discharge body usable in both the ordinary and inverted postures, has a substituting ambient air suction port (202) which is formed in a lower portion of the suction pipe in a vicinity of a lower end opening (201) of said suction pipe.

* * * * *